US005626702A

United States Patent [19]

Sharpe et al.

[11] Patent Number: 5,626,702

[45] Date of Patent: May 6, 1997

[54] PROCESS FOR PRODUCTION OF FLEXIBLE LAMINATE

[75] Inventors: Richard A. Sharpe; Mia J. Manners, both of San Francisco, Calif.

[73] Assignee: Holotex Limited, England

[21] Appl. No.: 638,010

[22] Filed: Apr. 25, 1996

Related U.S. Application Data

[63] Continuation of Ser. No. 150,057, filed as PCT/GB92/00903, May 18, 1992, abandoned.

[30] Foreign Application Priority Data

May 17, 1991 [GB] United Kingdom ..... 9110765

[51] Int. Cl.[6] ..... B44C 1/165

[52] U.S. Cl. ..... 156/233; 156/238; 156/241

[58] Field of Search ..... 156/230, 233, 156/234, 238, 240, 241, 247, 267, 344

[56] References Cited

U.S. PATENT DOCUMENTS

| | | | |
|---|---|---|---|
| 3,944,454 | 3/1976 | Burgheimer | 156/273 |
| 4,645,555 | 2/1987 | Kuboyama | 156/234 |
| 4,657,803 | 4/1987 | Pernicano | 428/200 |
| 4,724,026 | 2/1988 | Nelson | 156/233 |
| 4,728,377 | 3/1988 | Gallagher | 156/58 |
| 4,838,965 | 6/1989 | Bussard | 156/83 |
| 4,971,646 | 11/1990 | Schell et al. | 156/244 |
| 5,300,169 | 4/1994 | Tahara | 156/230 |
| 5,360,501 | 11/1994 | Bolt | 156/101 |
| 5,520,973 | 5/1996 | Kamen et al. | 428/35.7 |

FOREIGN PATENT DOCUMENTS

| | | |
|---|---|---|
| 0242457 | of 1987 | European Pat. Off. . |
| 0291160 | of 1988 | European Pat. Off. . |
| 0294936 | of 1988 | European Pat. Off. . |
| 0328086 | of 1989 | European Pat. Off. . |
| 8533471 | of 1986 | Germany . |
| 8533912 | of 1986 | Germany . |
| 2205533A | of 1988 | United Kingdom . |

OTHER PUBLICATIONS

"Fashion of the Future", Screen And Display, Dec. 1991, pp. 16–17.

*Primary Examiner*—James Sells

*Attorney, Agent, or Firm*—Zarley, McKee, Thomte, Voorhees & Sease

[57] ABSTRACT

The invention relates to a process for the production of a flexible laminate. The process comprises applying in a surface of a flexible substrate a curable composition in fluid form and comprising a plastics material as a pattern which can provide a desired image or imaging effect. Then, a metal foil bearing a holographic image and having a layer of plastics size is positioned with the size layer overlying the pattern while the composition remains fluid. Next there is applied to the combination sufficient heat and pressure at a level and for a time to adhere the foil to the substrate via the plastics material but insufficient to destroy the holographic effect. Thereafter excess foil not adhered to the substrate is removed to expose the desired image or imaging effect. The result is a flexible laminate having a flexible holographic image which can be machine washable.

25 Claims, No Drawings

PROCESS FOR PRODUCTION OF FLEXIBLE LAMINATE

This is a continuation of application Ser. No. 08/150,057 filed on Nov. 17, 1993, now abandoned based upon International Application PCT/GB92/00903 filed on May 18, 1992 and which designated the U.S.

The present invention relates to the production of a laminate, in particular to a process for the production of a laminate in the form of a holographic image, typically displayed on an article of clothing.

In our co-pending Application No. 91 02825.8 there is described and claimed a process for the production of a flexible laminate in which an outer and visible layer provides a holographic effect, which process comprises bringing together a metal foil bearing a holographic image, and having a layer of plastics size, and a flexible substrate in which at least an outer layer comprises a plastics material which is compatible with said size sufficient to enable the plastics material and size to adhere together under conditions of temperature and pressure which do not destroy the holographic effect, the substrate and foil being brought together with their plastics layers adjacent each other, and applying to the combination heat and pressure at a level and for a time sufficient to adhere the foil to the substrate but insufficient to destroy the holographic effect.

The present invention relates to an improvement in and/or modification of the earlier process in which the outer layer of plastics material compatible with said size is a plastics material which has been provided e.g. by printing, as a pattern which gives a desired image on a surface of a flexible substrate, typically a textile material, and more typically one already made up into an article of clothing.

Accordingly, the present invention provides a process for the production of a flexible laminate, which process comprises applying to a surface of a flexible substrate a curable composition in fluid form and comprising a plastics material as a pattern which can provide a desired image or imaging effect, positioning a metal foil bearing a holographic image and having a layer of plastics size, with the size layer overlying the pattern while the composition remains fluid, applying to the combination heat and pressure at a level and for a time sufficient to adhere the foil to the substrate via the plastics material but insufficient to destroy the holographic effect, and thereafter removing excess foil not adhered to the substrate to expose the desired image or imaging effect.

In carrying out the process of the invention the composition comprising a plastics material may be applied as a pattern by any suitable means. Preferably, however, the composition is applied by silk screen printing and the screen mesh is chosen to match the fineness of the image required.

The process of the invention uses a composition in fluid form comprising a plastics material. Such compositions are known and generally are:

Screen printable

Of sufficient viscosity to hold an image whilst wet

Flexible when cured, and

Compatible with sized foil.

Preferably, the process of the invention uses a composition which comprises a plastics material suspended in a plasticiser. More preferably, in such compositions the plastics material is PVC and the plasticiser is a plastisol ink. One such known composition based on PVC and a plastisol is that sold as Metatran.

In the process of the invention, the metal foil bearing a holographic image may be any flexible metal foil, but preferably is an aluminium foil. Such foils are commercially available as hot stamping foils bearing a holographic pattern which are produced to provide a foil to be applied to a rigid substrate, typically a rigid plastics material. The rigid substrate provides a support for the foil so that the holographic effect may be stabilized. Typically, the size of a commercial foil is a PVC (polyvinyl chloride), which is preferred for the foils used in the invention, but other plastics size layers may be employed in the present invention provided they can be adhered to a compatible plastics material in a composition as described above.

Also, the foil used in the process of the invention preferably includes a release layer on that surface of the metal foil which does not carry the layer of plastics size. That release layer can serve to provide additional protection for the holographic pattern and is removed after treatment in the process of the invention and before the holographic effect is required. A typical release layer may comprise a polymeric material, for example, a polyester.

In the process of the invention the flexible substrate may be any such substrate provided only that it is flexible. Preferably, however, the substrate is a woven or non-woven web, typically a fabric, and more preferably one which is both flexible and stretchable. Most preferably, however, the fabric is a natural fabric.

Typically, the fabric may be a silk, cotton, a cotton/synthetic mix, Lycra, acetate, satin, organza, chiffon, linen, microfibre, viscose or a simulated suede or any other similar fabric.

Preferably, the flexible substrate is one which has already been made up into a garment of clothing. Thus, typically the substrate is a fabric forming part of a finished garment.

In carrying out the process of the invention, the foil and substrate are fed to a laminating station at which heat and pressure can be brought to bear on their combination. The feeding to the laminating station may be on a continuous or batch basis depending on the requirements of the process being effected. Thus, typically the foil or substrate may be supplied continuously or intermittently from rollers on which they may be stored.

The laminating station may comprise any form of apparatus or device which can supply heat and pressure under the general requirements stated herein. Furthermore, the construction and arrangement of the station may be varied to suit continuous or batch operation. Thus, in one preferred aspect of the invention the laminating station may comprise at least two rollers between which the foil and substrate may be fed to be pressed together and heated. Alternatively, in another preferred aspect the foil and substrate may be brought together in a heated press which typically may comprise upper and lower heated plates which can be brought together under pressure.

Generally, the process of the invention is effected under conditions of temperature and time which at least essentially avoid bubble formation. In that respect, the temperature is believed to be the determining factor and preferably the temperature used to effect adhesion or bonding is one in the range of from about 100° C. to about 110° C. and typically no higher than about 112° C.

Above that higher temperature bubbles tend to form too readily and colours are diminished or disappear. Accordingly, for optimum results in terms of adhesion and brightness of finished image a temperature in the given range should be used, and preferably about 100° C.

As to pressure, it is preferred to use as high a pressure as is possible within the limits of the press or other apparatus employed, and subject to the requirements of the image or imaging effect to be produced. Typically, a pressure of at or above about 200 gm/cm$^2$ may be used, for example, a pressure of about 200 to about 210 gm/cm$^2$ such as a pressure of about 208 gm/cm$^2$ which may be applied in a 1000 kg press with a plate area of 0.4 m×1.2 m.

Generally speaking, in the process of the invention, the heat and pressure are applied for a sufficient time to enable laminate formation to take place. Thus, a variety of dwell times may be employed, although a dwell time of about 20 to about 60 seconds is preferred, more preferably about 22 seconds, especially under the conditions mentioned above.

Fabric treated by the process of the invention is a fully flexible laminate which generally has the same or a similar high degree of flexure as the flexible substrate from which it is made. Thus, the laminate should always be capable of a high degree of flexure and a treated fabric, for example, should be capable of behaving as a fabric essentially the same as the original fabric.

In the prior art it is known to apply silver and gold foils to articles of clothing using a Metatran adhesive. However, in prior art processes the adhesive is always cured to a hard state before application of the foil and the temperatures used in the pressing operation are very much higher, typically about 170° C.

In accordance with the present invention it is an unexpected and surprising effect that by using a fluid composition and applying a foil while the composition is still fluid one obtains a cleaner, clearer, and often finer print. Also, by using preferred temperatures in the range of about 100° C. to about 110° C., those at or above 170° C. which could destroy the holographic foil are avoided.

The invention will now be illustrated by the following specific examples:

EXAMPLE 1

A 100% cotton tee-shirt was printed on its front face with a fine image involving half tones using a silk screen mesh 49T and a fluid composition comprising PVC suspended in a plastisol ink supplied as Metatran adhesive by Sericol of London, United Kingdom. The tee-shirt was then while the adhesive was still in a fluid (or uncured) state laid adhesive side uppermost on a heat transfer press as supplied by Imagine Transfers of Braintree, United Kingdom. Next, a sheet of holographic foil (EP49 with PVC 68 sizing) having dimensions to cover the image was laid over the image with the surface having the PVC size in contact with the wet or fluid adhesive.

The laminate of tee shirt front and foil was then subjected to a temperature of about 100° C. for about 22 seconds in the press, after which the combination was allowed to cool. Finally, the foil was carefully peeled away to remove excess (unstuck) foil to leave a tee-shirt finely decorated with a holographic pattern in the image of the pattern of adhesive laid down with the silk screen.

The tee-shirt with the holographic image was machine washable at 40° C. and could be tumble dried without destruction of the image or the holographic effect.

EXAMPLE 2

Example 1 was repeated except that an image was applied to the rear of a waistcoat made of a fleece fabric. Similar results were obtained and again the waistcoat was machine washable and able to be tumble dried without destruction of the image or the holographic effect.

EXAMPLE 3

Example 1 was repeated, this time with a tee-shirt made of 50% cotton and 50% polyester with essentially the same results.

It is of course to be understood that the invention is not limited to the specific details given above and numerous variations may be made within the spirit and scope of the claims which follow.

We claim:

1. A process for the production of a flexible laminate, the process consisting essentially of applying to a surface of a flexible substrate a curable composition in fluid form and comprising a plastics material as a pattern which can provide a desired image or imaging effect, positioning a metal foil bearing a holographic image and having a layer of plastics size, with the size layer overlying the pattern while the composition remains fluid, applying to the combination heat and pressure at a level and for a time sufficient to adhere the foil to the substrate via the plastics material but insufficient to destroy the holographic effect, and thereafter removing excess foil not adhered to the substrate to expose the desired image or imaging effect.

2. A process according to claim 1, wherein the composition is applied by silk screen printing.

3. A process according to claim 1, wherein the composition comprises a plastics material suspended in plasticiser.

4. A process according to claim 1, wherein the plastics material is PVC.

5. A process according to claim 3, wherein the plasticiser is a plastisol ink.

6. A process according to claim 1, wherein the metal foil bearing the holographic image is an aluminium foil.

7. A process according to claim 1, wherein the foil is a hot stamping foil bearing a holographic pattern.

8. A process according to claim 1, wherein the size of the foil is a polyvinyl chloride.

9. A process according to claim 2, wherein the foil includes a release layer on that surface of the metal foil which does not carry the layer of plastics size.

10. A process according to claim 9, wherein the release layer is removed after treatment and before the holographic effect is required.

11. A process according to claim 1, wherein the flexible substrate is a woven or non-woven web.

12. A process according to claim 11, wherein the flexible substrate is a fabric.

13. A process according to claim 12, wherein the fabric is a natural fabric.

14. A process according to claim 1, wherein the substrate is one which is not only flexible but also stretchable.

15. A process according to claim 1, wherein the foil and substrate are fed to a laminating station at which heat and pressure can be brought to bear on their combination.

16. A process according to claim 15, wherein the feeding to the laminating station is on a continuous or batch basis.

17. A process according to claim 1, wherein the foil and the substrate are supplied continuously or intermittently from rollers on which they are stored.

18. A process according to claim 1, wherein the foil and substrate are brought together between at least two rollers.

19. A process according to claim 1, wherein the foil and substrate are brought together in a heated press which comprises upper and lower heated plates which can be brought together under pressure.

20. A process according to claim 1, wherein the temperature conditions are from about 100° C. to about 110° C.

21. A process according to claim 1, wherein the temperature is about 100° C.

22. A process according to claim 1, wherein the pressure is at least about 200 gm/cm$^2$.

23. A process according to claim 22, wherein the pressure is from about 200 gm/cm$^2$ to about 210 gm/cm$^2$.

24. A process according to claim 1 wherein the dwell time during which the temperature and pressure conditions apply is from about 20 to about 60 seconds.

25. A process for the production of a flexible laminate, comprising:

providing a metal foil sheet having opposite surfaces, one of the surface bearing a preexisting holographic image thereon such that the metal foil sheet having the holographic image thereon has a given degree of flexibility, the opposite surface having a layer of substantially flexible plastics size applied thereto;

providing a substantially flexible substrate having an exposed surface thereon;

applying to the exposed surface on the substrate a curable composition in fluid from and comprising a plastics material as a pattern which can provide a desired pattern;

forming a hologram/substrate combination by:

positioning directly on the exposed surface having the curable composition the surface of the metal foil sheet having the layer of plastics size applied thereto with the layer of plastics size overlying the pattern while the curable composition remains fluid, applying to the hologram/substrate combination heat and pressure at a level and for a time sufficient to adhere the foil to the substrate via the plastics material but insufficient to destroy or diminish the holographic image; and thereafter removing excess foil not adhered to the substrate to expose the desired pattern;

whereby the heated and pressed combination yields a hologram joined to the substrate such that the combination has a flexibility which is substantially the same as the flexibility of the substrate.

* * * * *